US008126174B2

(12) United States Patent
Kornagel

(10) Patent No.: US 8,126,174 B2
(45) Date of Patent: Feb. 28, 2012

(54) HEARING DEVICE WITH A MULTI-STAGE ACTIVATION CIRCUIT AND METHOD FOR OPERATING IT

(75) Inventor: Ulrich Kornagel, Erlangen (DE)

(73) Assignee: Siemens Medical Instruments Pte. Ltd, Singapore (SG)

( * ) Notice: Subject to any disclaimer, the term of this patent is extended or adjusted under 35 U.S.C. 154(b) by 908 days.

(21) Appl. No.: 12/217,416

(22) Filed: Jul. 3, 2008

(65) Prior Publication Data

US 2009/0010464 A1 Jan. 8, 2009

(30) Foreign Application Priority Data

Jul. 4, 2007 (DE) ..... 10 2007 030 961

(51) Int. Cl.
*H04R 25/00* (2006.01)

(52) U.S. Cl. ..... 381/312; 381/57; 381/313; 381/317; 381/318; 381/319; 381/320; 381/321; 381/322

(58) Field of Classification Search ..... 381/57, 381/312, 313, 317–322
See application file for complete search history.

(56) References Cited

U.S. PATENT DOCUMENTS

| | | | | |
|---|---|---|---|---|
| 7,006,650 | B1 | 2/2006 | Wild | |
| 7,620,194 | B2 * | 11/2009 | Sayler et al. | 381/312 |
| 2002/0076073 | A1 | 6/2002 | Taenzer et al. | |
| 2004/0131214 | A1 | 7/2004 | Galler et al. | |
| 2005/0207602 | A1 | 9/2005 | van Oerle | |

FOREIGN PATENT DOCUMENTS

| | | | |
|---|---|---|---|
| DE | 4410445 | A1 | 9/1995 |
| EP | 0676909 | A1 | 10/1995 |
| EP | 1150633 | B1 | 3/2004 |
| EP | 1850636 | A2 | 10/2007 |
| WO | WO 0120965 | A2 | 3/2001 |
| WO | WO 0207480 | A2 | 1/2002 |

* cited by examiner

*Primary Examiner* — Jasmine Clark

(57) ABSTRACT

In one aspect, a hearing device is provided with a multi-stage activation circuit including a primary activation unit, an evaluation unit and a main activation unit. The primary activation unit monitors a sound-induced input level and forwards incoming signals to the evaluation unit when a threshold value of the input level is exceeded. The evaluation unit is activated when the threshold value is exceeded and determines a feature of incoming signals suitable for identifying and/or classifying a sound causing the incoming signals. The main activation unit is activated, for example, when the feature determined by the evaluation unit indicates a noise that should be perceptible to the wearer of the hearing device. The main activation unit activates further components of the hearing device including the signal processing and amplification circuit and the output unit.

17 Claims, 2 Drawing Sheets

HEARING DEVICE WITH A MULTI-STAGE ACTIVATION CIRCUIT AND METHOD FOR OPERATING IT

CROSS REFERENCE TO RELATED APPLICATIONS

This application claims priority of German application No. 10 2007 030 961.0 DE filed Jul. 4, 2004, which is incorporated by reference herein in its entirety.

FIELD OF INVENTION

The invention relates to a hearing device with a multi-stage activation circuit and a method for operating it.

BACKGROUND OF INVENTION

Hearing devices are primarily medical aids to compensate for a very wide range of hearing impairments. They are therefore on the one hand an important link for communication, in particular for the perception of ambient noise, by the hearing device wearer. To this end they should allow a largely natural hearing sensation with the highest possible level of convenience for the user and on the other hand they should ensure, regardless of any equipment variants, that at least certain important ambient noises can be perceived in a reliable and classifiable manner by the hearing device wearer.

Increasing convenience requirements are associated with greater complexity and a corresponding energy requirement for modern hearing devices. At the same time, to reduce weight and for aesthetic reasons, every endeavor is made to use the smallest possible energy sources, frequently in the form of batteries, with the result that the energy sources used have a relatively limited capacity. It is therefore desirable, at times when corresponding sound amplification is clearly not necessary, to decouple as many energy-consuming components as possible, in particular the amplifier and signal-processing circuits, from a power supply or to switch off the hearing device as a whole.

It is known that hearing devices can be designed so that corresponding components can detect removal of the hearing device by the patient and in such instances interrupt the power supply automatically and the hearing device is switched off (DE 4410445A1). This procedure excludes the retention of a certain functionality of the hearing device for the hearing device wearer, which can however be ignored, as by removing the hearing device the hearing device wearer has generally decided to dispense with the technical assistance of the hearing device.

SUMMARY OF INVENTION

In many instances it is however advantageous, if a hearing device wearer can wear and keep his/her hearing device(s) functional as permanently as possible, so that he/she is not totally acoustically decoupled from his/her environment at any time. In many situations, where no sound event is anticipated, power would however be consumed unnecessarily during regular operation, as in particular the microphone, electronic signal processing and/or evaluation circuits and an amplifier line with a speaker connected in some instances would be kept in permanent readiness, even though signal processing and/or amplification was actually not required. Exemplary situations occur in particular for the hearing device wearer when at rest during the night. During this time the interval between sounds that have to be amplified and are of relevance to the hearing device wearer can be a number of hours, which is associated with a considerable energy consumption, which is simply caused by retention of the functionality of the hearing device. Total disconnection of the hearing device without any action on the part of the hearing device wearer is however not seen as advantageous in such instances, as the hearing device wearer would as a result be more or less, and in serious instances totally, decoupled acoustically from his/her environment, depending on his/her individual hearing loss. Said hearing device wearer would no longer be able to hear warning signals, ringing alarm clocks, telephone sounds and similar key noises and would therefore not be able to respond to them. Even in phases of total rest on the part of the hearing device wearer such unconditional acoustic decoupling is frequently not desirable.

It is known that hearing devices can switch automatically to an operating mode, which is a function of ambient noise. It is known that ambient noise can be classified and sound settings can be adjusted automatically at the hearing device by corresponding parameter selection. It is also known that ambient noise can be analyzed in the field of hearing protection and in the case of classified noise its transmission can be permitted or suppressed (EP 1150633B1).

It is also known that it is possible for hearing devices to switch automatically between a standard operating mode and a rest mode, with the criterion used for the switch between the operating modes being one or more threshold values of an applied input signal and/or parameters obtained from analyses of the signal dynamics (WO 02/07480). In order to ensure a smooth switch between operating modes, threshold-based systems in particular have to operate with a relatively large hysteresis. The disadvantage of systems which operate with derived parameters is primarily that relatively complex signal processing has to be undertaken, with the circuit required for such signal processing itself already having a power consumption, which significantly exceeds a desirable low power consumption during long acoustic pauses.

WO 01/20965 A2 discloses a method for determining a current acoustic ambient situation and the application of the method in a hearing device. To this end the hearing device has a transmission unit in addition to microphones and a receiver. The signals picked up by the microphones are classified by means of a signal analysis unit and a signal identification unit and the hearing program corresponding to the current ambient situation is activated.

The object of the invention is to specify a way in which a hearing device can be operated in the most power-saving and convenient manner, without decoupling the hearing device wearer totally from his/her environment.

This object is achieved with the aid of a hearing device and a method for operating an inventive as claimed in the independent claims. Dependent claims describe advantageous embodiments.

The invention is based on the use of a multi-stage circuit to activate a hearing device. In a standard operating mode the hearing device is used, as in conventional embodiments, to pick ambient sound by way of a microphone, convert it to electrical signals, adapt and/or amplify these if necessary and ensure corresponding stimulus generation in the region of the ear of the hearing device wearer by transmitting sound waves in the ear of the hearing device wearer and/or by otherwise prosthetic stimulus induction. If a situation is identified, in which there is clearly no need for sound amplification, the hearing device is switched automatically to a rest mode. This can advantageously take place, if a minimum sound level has not been exceeded over a certain time period. The hearing device is thus switched to a rest mode in situations where power is to be saved and/or the hearing device does not have to amplify sound.

The invention can be deployed with a hearing device with a multi-stage activation circuit, comprising a microphone, a signal processing and amplification circuit and an output unit with a primary activation unit being included as the first stage of the activation circuit, an evaluation unit as the second stage of the activation circuit and a main activation unit as the third stage of the activation circuit, with the primary activation unit being designed so that it can monitor at least one sound-induced input level and forward incoming signals to the evaluation unit if a threshold value of this input level is exceeded, the evaluation unit being designed so that if a threshold value of at least one sound-induced input level is exceeded it can be activated and can determine at least one feature of incoming signals, which is suitable for identifying and/or classifying a noise causing the incoming signals and the main activation unit being designed so that it can be activated, if the at least one feature determined by the evaluation unit indicates a noise that should be perceptible to the wearer of the hearing device, with the main activation unit being provided to activate further components of the hearing device including the signal processing and amplification circuit and the output unit. Features of incoming signals, which are particularly suitable for identifying and/or classifying a noise causing the incoming signals, appear to be physical parameters, in particular time-based physical parameters and/or their temporal pattern.

The automatic switching process for the switch to rest mode can be supplemented by the possibility of a manual disconnection and/or switch to a rest mode, which is for example expedient if a hearing device wearer knows that no relevant sound events are anticipated in the immediate future. This dispenses with the longer phase of device readiness, in which a sound event would be permanently anticipated, until the automatic switch to rest mode takes place after a minimum time period has passed without a sound level threshold being exceeded. A manual switch to a rest mode can also be expedient if the hearing device wearer does not wish to be distracted by ambient noise, as may be the case for example when working without interruption, reading a book or for other activities, during which said wearer nevertheless does not want to or cannot be totally decoupled acoustically from the environment, in order for example to be able to perceive warning signals, telephone sounds and similar noises.

According to the invention these requirements are realized in an extremely power-saving manner, in that during the phase in which the hearing device is in rest mode only a primary activation unit is active, which checks whether or not a sound pressure applied by way of the microphone is adequate to generate a minimum input level. If a minimum input level is exceeded, the hearing device as a whole, including the amplifier section, is not activated immediately but a further activation unit is simply activated, which carries out a more precise analysis of the incoming signal and ensures full activation of the hearing device as a function of the result of this signal analysis or, if the signal analysis shows that the incoming signal is only a noise that is not of relevance to the hearing device wearer or is interfering noise, ensures the return of the hearing device to rest mode, in which only the first or primary activation unit is active.

The invention therefore also consists of any method for activating a hearing device with a multi-stage activation circuit, comprising a microphone, a signal processing and amplification circuit and an output unit, in which a primary activation unit, as the first stage of the activation circuit, first monitors at least one sound-induced input level and if a threshold value of this input level is exceeded, activates an evaluation unit as the second stage of the activation circuit and forwards incoming signals to the evaluation unit, the evaluation unit determines at least one feature, in particular a physical parameter, of the forwarded incoming signals, which is suitable for identifying and/or classifying the noise causing the incoming signals and, in the event of the identification and/or classification of a noise that should be perceptible to the hearing device wearer, then activates a main activation unit as the third stage of the activation circuit, which then ensures the activation of further components of the hearing device, including the signal processing and amplification circuit and the output unit. This inventive method can advantageously be supplemented by alternative activation algorithms.

BRIEF DESCRIPTION OF THE DRAWINGS

The invention is described in more detail below with reference to an exemplary embodiment. In the figures.

DETAILED DESCRIPTION OF INVENTION

Figure 1:
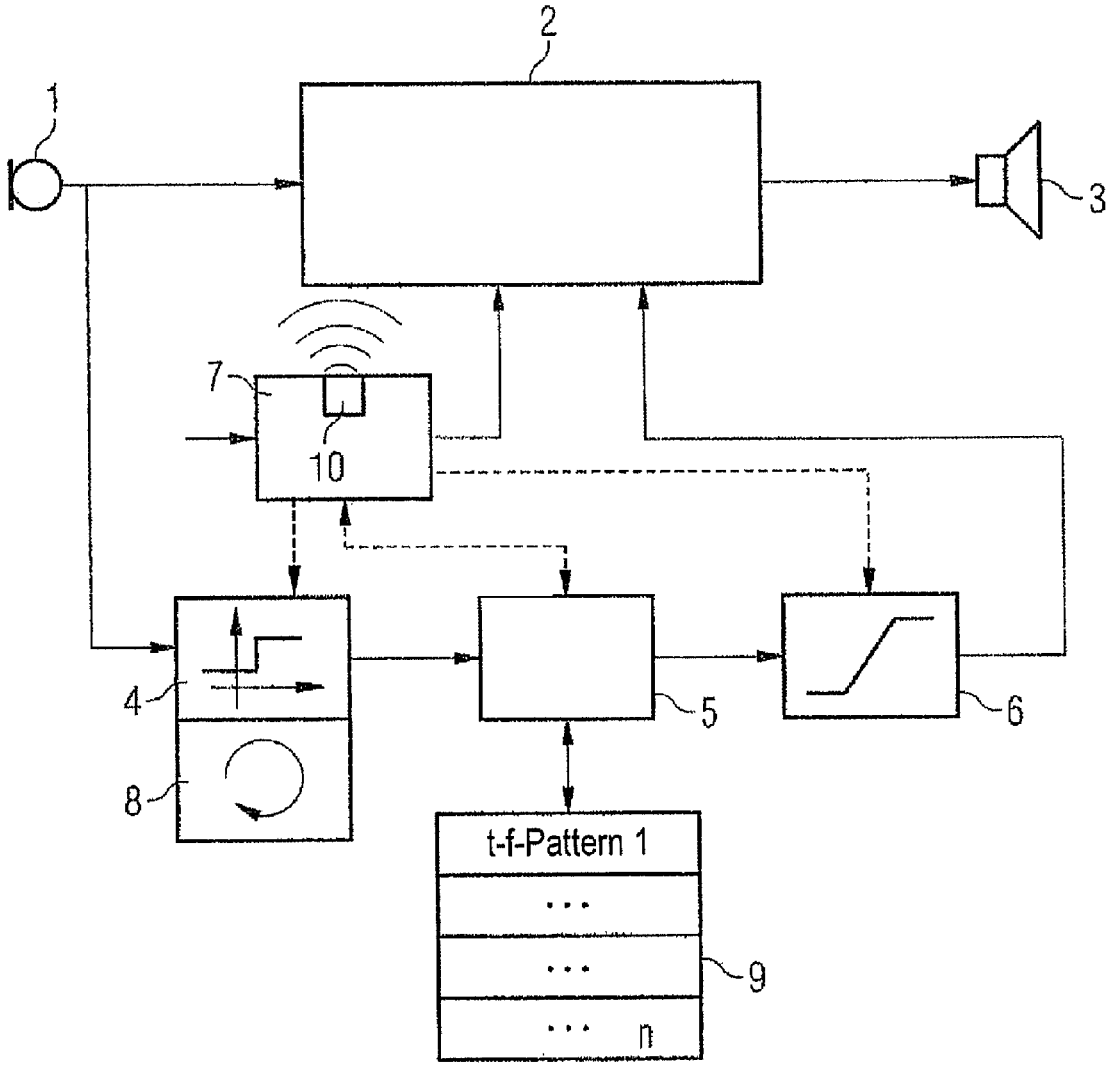
FIG. 1 shows a schematic diagram of the essential components of an inventive hearing device.

FIG. 1 shows a schematic diagram of the essential components of an inventive hearing device. These components include a microphone 1, a signal processing and amplification circuit 2, an output unit 3 in the form of a speaker to be worn in the ear and in inventive hearing devices a primary activation unit 4 as the first stage of the activation circuit, an evaluation unit 5 as the second stage of the activation circuit and a main activation unit 6 as the third stage of the activation circuit. A fourth stage 7 of the activation circuit is also included, which is not involved or does not have to be involved directly in the signal flow during activation but serves to realize certain convenience functions through manual requests etc.

The pattern of an inventive activation of a hearing device is explained based on a typical exemplary situation. While the hearing device is in a rest mode, only the primary activation unit 4 is active, being advantageously equipped with a signal buffer 8. This primary activation unit 4, as the first stage of the activation circuit, is permanently active and therefore, if the hearing device is in rest mode, is the only active and therefore power-consuming unit in addition to the microphone 1. If a certain minimum input level generated by the microphone 1 is present at this primary activation unit 4 for a certain period, the evaluation unit 5 is activated as the next stage of the activation circuit, representing a first activation process. To this end it is advantageous within the meaning of the invention, if the primary activation unit is designed so that it can monitor at least one sound-induced input level and, if a threshold level of this input level is exceeded, can forward incoming signals to the evaluation unit and activate the evaluation unit.

If the primary activation unit 4 is provided with an input signal buffer 8, which is permanently written to, it is advantageous if this input signal buffer 8 is dimensioned so that during the permanent writing process it can record so many samples of the input signal that the time taken by the primary activation unit 4 to detect and execute the first activation process is bridged. This means that no signal components are lost to the second stage of the activation circuit in the form of the evaluation unit 5 but they can all be included in the signal evaluation within the evaluation unit 5, in other words the second stage of the activation circuit.

In the evaluation unit 5 the input signal present after the first activation process is evaluated, preferably taking into account signals to be supplied from the signal buffer 8. The evaluation advantageously includes a time-based analysis of the frequency pattern of the signals present at the evaluation unit 5. From this frequency analysis it is possible to derive decision criteria, on which the further procedure for activating the hearing device depends. Frequencies contained in the incoming signals and/or the temporal pattern of their occurrence, as time-based physical parameters, thus represent features, which are suitable for identifying and/or classifying a noise caused by the incoming signals within the meaning of the invention.

Alternatively signal processing and/or signal evaluation in the evaluation unit 5 can also be designed so that other signal parameters, which allow identification and/or classification of hearing situations, to be derived from the input signal of the evaluation unit 5. To this end it is advantageous within the meaning of the invention, if the evaluation unit 5 is designed so that it can determine at least one parameter of incoming signals, which is suitable for identifying and/or classifying a noise causing the incoming signals and can activate the main activation unit 6, if the at least one parameter determined by the evaluation unit 5 indicates a noise that should be perceptible to the hearing device wearer. Essentially the deployment of the invention relates not to the type of parameter or feature to be determined but to its suitability for the most unambiguous identification and/or classification possible of a noise causing the incoming signals, even though in particular physical parameters are particularly well suited.

The evaluation by frequency analysis of the signals by the evaluation unit 5 allows a comparison of the t-f pattern (time-frequency pattern) obtained from the evaluated signals with prototype t-f patterns stored locally in a storage unit 9 of the evaluation unit 5. As with voice recognition systems known acoustic situations are analyzed for this purpose and the resulting t-f patterns are stored, so that they can be retrieved for comparison with t-f patterns, which are obtained later in acoustic situations to be analyzed. The prototype t-f patterns stored in the storage unit 9 of the evaluation unit 5 in the present invention characterize acoustic situations, in which activation of the hearing device is to be initiated. Only if the analysis of the input signal produces a t-f pattern, which is sufficiently similar to a stored prototype t-f pattern, is the hearing device fully activated by way of the main activation unit 6 as the third stage of the activation circuit, in other words the conventional signal processing and amplification function is activated.

The set of stored prototype t-f patterns can be compiled from patterns predetermined by the producer, which can be supplemented by t-f patterns to be added or trained individually by the hearing device wearer. Examples of t-f patterns predetermined by the producer can include a typical telephone ring, typical alarm clock noises, typical speech patterns and/or music patterns, which can be produced for example by a radio alarm clock, human voices, etc. Recognition accuracy should be improved in the respective environment of the hearing device wearer by said hearing device wearer supplementing or replacing the t-f patterns predetermined by the producer with his/her own t-f patterns, which can be recorded in the actual environment of the hearing device wearer. These include for example the ring of his/her own telephone, the ring of his/her own door bell or alarm clock, certain kitchen noises, such as the whistling of the kettle and/or noises generated by the hearing device wearer him/herself or those living with him/her, such as his/her own voice, the voices of fellow residents, his/her own snoring, a dog barking, noises of other pets and further specific noises, which can be anticipated and should optionally be evaluated in the respective ambient situation of the hearing device wearer.

Voice recognition is particularly advantageous, if provision is made for the hearing device to be switched immediately to active operating mode by recognition of the hearing device wearer's own voice when said hearing device is briefly addressed. Other typical noises are advantageously included in the t-f patterns for activation purposes, when said noises are to involve certain actions on the part of the hearing device wearer. Thus the recognition of a t-f pattern caused by the snoring of the hearing device wearer can result in the snorer perceiving the snoring with sudden amplification after activation of the hearing device and being woken by it and/or consciously or unconsciously changing sleeping position so that the snoring is suppressed in the future.

Similarly specific amplification of the barking of a dog can result in the hearing device wearer waking up and taking the dog out to avoid hygienically problematic situations, this being applied in a similar manner to communication with other pets living in the household of the hearing device wearer, particularly cats.

One advantage compared with voice recognition systems is the relatively small number of t-f patterns to be stored, meaning that a relatively small storage unit 9 is sufficient within the evaluation unit 5, which is in turn associated with a low energy requirement of the evaluation unit 5. It is particularly advantageous, if the hearing device wearer can select the activation pattern he/she requires from the stock of patterns. It is then possible to deselect t-f patterns supplied by the producer if the hearing device wearer feels they have little relevance to his/her personal situation. This provides additional free space for individually favored t-f patterns.

It is advantageous, in particular in conjunction with a relatively limited number of stored t-f patterns, if the evaluation unit 5 of the hearing device generally initiates activation, when a predetermined minimum level is present for a certain minimum period. This minimum level can be predetermined by the producer or can be set by the respective user of the hearing device. This is important if a relatively high level is present for quite a long period without a stored t-f pattern having a sufficient similarity, as required for activation, to the non-analyzable t-f pattern of the input signal at the evaluation unit 5. Thus the integral of the input signal over time in this instance forms a further threshold value, the exceeding of which results in unconditional activation of the hearing device. This threshold value is determined here in such a manner that at least an adequate time period elapses, in which recognition of stored t-f patterns can take place by means of a comparison operation carried out in the evaluation unit 5.

Predetermining the threshold value of the integral of the input signal over time at a correspondingly high level advantageously ensures that unidentifiable noises are not ranked equally with noises identified or classified according to the invention. The integral of the input signals is therefore determined over a considerably longer time period than is required to identify a noise. This is only deviated from, if a very high level of the input signal is present and immediate activation is necessary.

In this exemplary embodiment therefore the activation of the hearing device as a function of the exceeding of a first threshold value of a sound-induced input level represents a form of activation that is also a function of identified t-f patterns or a further threshold value. Once the activation criteria have been met and activation has been carried out successfully, operation of the hearing device is not necessarily bound by permanent presence of the activation criteria. It is sufficient for example simply to initiate a check cyclically to determine whether predetermined activation criteria are still met. This ensures smooth activation.

With exclusively threshold-based activation without identification of a t-f pattern the hearing device wearer can him/herself optionally clarify the cause of the longer-term noise and remedy it or store it as a typically known but hitherto not taken into account t-f pattern in the storage unit 9 of the activation unit 5, thereby including it in future in the menu for verifying the need for full activation of the hearing device.

If no activation pattern is identified, in other words there is no input signal present at the evaluation unit 5 which can be described by a t-f pattern which has a sufficient similarity to a t-f pattern stored in the storage unit 9 of the evaluation unit 5 and if a predetermined minimum level is not present for a predetermined minimum time period, the evaluation unit 5 is deactivated again as the second stage of the activation circuit. The hearing device therefore remains in rest mode. One exemplary signal for the latter instance is the rustling of clothing, bedding and/or hair during movement of the hearing device wearer when asleep, if this noise does not continue for the predetermined minimum period, since no t-f pattern is preferably stored for such noises in the storage unit 9 of the evaluation unit.

The main activation unit 6 forms the third stage of the inventive activation circuit. If the evaluation unit 5 identifies a reason for activation in the illustrated manner, in other words if a high degree of correspondence between t-f patterns stored in the storage unit 9 and the time-based frequency pattern of the respectively incoming signal allows a noise to be identified or at least classified that should be perceptible to the wearer of the hearing device, the main activation unit 6 itself is activated. In the simplest instance the hearing device is switched on abruptly. In one advantageous embodiment the hearing device is started up slowly, in other words the amplification of incoming acoustic signals is increased to a setpoint value over a certain period, for example within a few seconds. This allows the hearing device wearer to become gradually accustomed to the effective ambient level. This is particularly important if activation of the hearing device takes place in rest phases of the hearing devices wearer, to avoid startle situations.

The main activation unit 6 represents the actual switching element for activation of the hearing device. The decision concerning actuation, in other words activation, of this switching element is prepared for in two stages in the preceding components, namely in the primary activation unit 4 by a constantly available, relatively non-specific but power-saving level monitoring operation and in the evaluation unit by the higher energy-consumption signal evaluation and differentiation, which only have to be active intermittently. The primary activation unit 4, the evaluation unit 5 and the main activation unit 6 thus form a three-stage activation circuit, with which it is possible to operate a hearing device in a power-saving and convenient manner, without decoupling the hearing device wearer totally from their environment at any time.

The inventive three-stage activation circuit is advantageously supplemented by a fourth stage 7 of the activation circuit, by way of which parallel activation requests and/or convenience functions can be deployed, in particular by manual intervention on the part of the hearing device wearer. Such a manually effected activation process can be realized by directly connecting the fourth stage 7 of the activation circuit to the signal processing and amplification circuit 2 or by the fourth stage 7 of the activation circuit triggering the main activation stage 6.

A repeat request can advantageously be realized by way of this fourth stage. It is thus possible, in the presence of a correspondingly occupied signal buffer 8, for example by way of a repeat key, to request the sound even for which the hearing device has been activated. This is particularly advantageous, if a signal resulting in activation of the hearing device is only present for a short time and would thus escape the notice of the hearing device wearer despite inventive activation. Since however the signal resulting in activation was stored in the signal buffer 8, which is primarily realized in the form of a digital storage unit, this signal can also be retrieved by the hearing device wearer at a later stage. Said hearing device wearer can thus understand later why the hearing device was activated, in other words for example why he/she was woken up or whether immediate action is required.

In one simple modification of the preceding example, in the event of a repeat request on the part of the hearing device wearer, the actual signal is not played back again but the category is simply stated, in which the sound event, clearly classified by the evaluation unit 5, belongs. This information can be transmitted as abstract output. For example the number of a stored prototype t-f pattern classified by the evaluation unit 5 can be output. The output itself can be effected here for example optically by way of a remote control or acoustically by way of a spoken text played by the hearing device.

The inventive activation can be used particularly advantageously in hearing device systems, in which both ears of a hearing device wearer are fitted with a hearing device. In such systems there is frequently a coupling between the two hearing devices. This coupling is preferably wireless. With such binaurally coupled hearing devices it is sufficient if one of the two hearing devices is activated in the inventive manner. The respective other device receives the activation request by way of the coupling. This is advantageous for example if the hearing device wearer is lying on one ear and the associated hearing device is therefore acoustically shielded, impeding the inventive monitoring of the input level. In this situation activation would not be possible or would be very unreliable for this hearing device without binaural coupling. If however in this instance both hearing devices of the binaurally coupled hearing device system are fitted with the inventive activation circuit, at least one of the two hearing devices can be activated if corresponding noises occur. The other hearing device is then activated directly by an activation signal, which is received and/or evaluated by the fourth stage 7 of the activation circuit. To this end the fourth stages 7 of the activation circuits can advantageously have a transmit and receive unit 10, which can receive and transmit corresponding activation signals. When the wearer of such a binaural hearing device system is awoken by noise, both hearing devices are then simultaneously in the fully activated operating state due to the coupled activation.

The signal paths shown by arrows between and to the individual components of the hearing device can advantageously also comprise wireless communication connections. It is thus possible to house individual stages of the inventive activation circuit in external additional devices, which should be considered in the context of the invention to be part of a hearing device or hearing device system, as is the case for example with remote controls.

Figure 2:
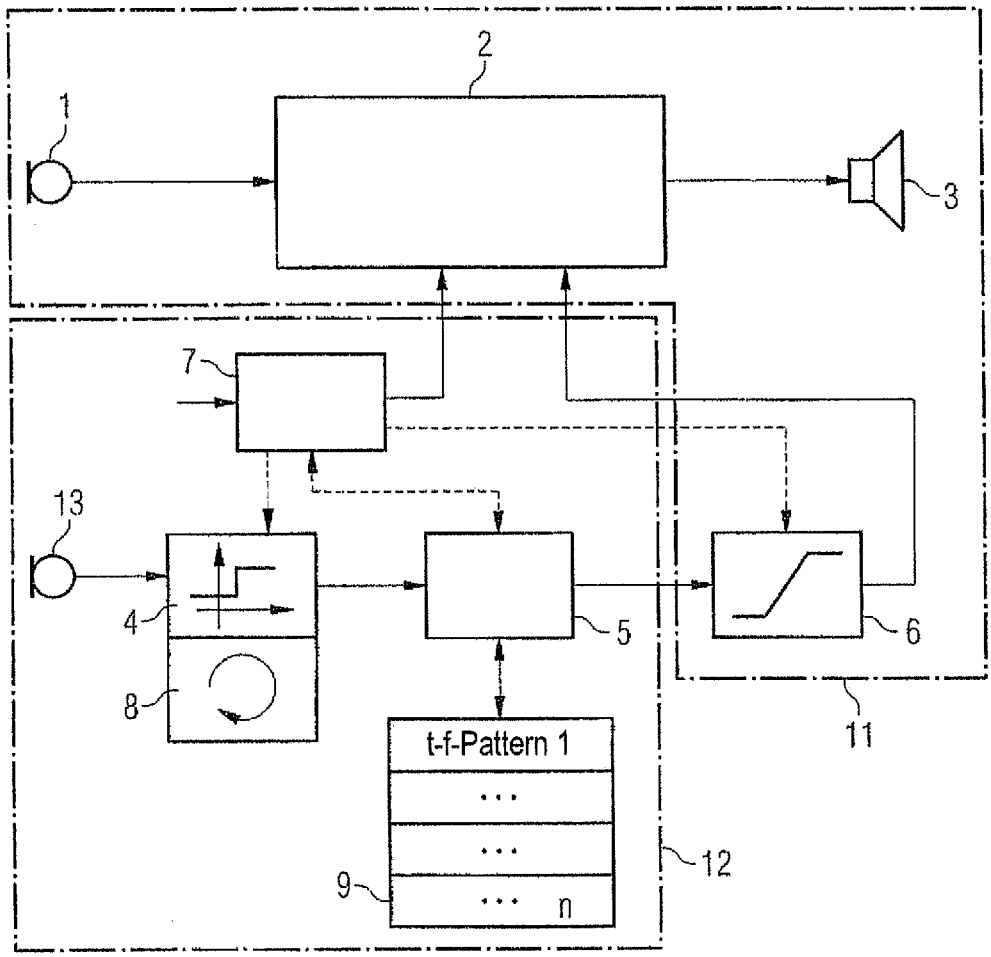
FIG. 2 shows a schematic diagram of a multi-component embodiment of an inventive hearing device.

FIG. 2 shows a schematic diagram of a multi-component embodiment of an inventive hearing device. It comprises a component 11 to be arranged on or in the ear of a hearing device wearer as well as an external additional device 12 in the form of a remote control. The inventive multi-stage activation circuit is allocated to the two components 11 and 12 in this instance. This ensures a further reduction in the load on the power supply of the component 11 to be worn in proximity to the ear, as external additional devices have their own less critically designed power supply. It is significant that all the components can communicate with one another in respect of circuits as in the exemplary embodiment as shown in FIG. 1, in some instances requiring observation of the range of included wireless communication connections in the case of externally located components. In the present instance the primary activation unit 4, the evaluation unit 5 and the fourth stage 7 of the activation circuit are parts of the remote control. In this instance only the main activation unit 6 has to be connected permanently to the actual hearing device, in other words a component 11 to be worn on or in the ear. The external additional device 12 in the form of a remote control also has its own microphone 13. This allows the inventive signal analysis, in other words the first two activation steps to be carried out completely in the remote control. Only when the activation criteria are met is a communication connection set up to the third stage of the activation circuit, in other words the main activation unit 6 on the component 11 on the ear of the hearing device wearer, after which full activation of the hearing device is effected. As well as achieving particularly low energy consumption in the hearing device component in proximity to the ear, the external microphone 13 of such a system also allows a particularly high level of activation reliability to be achieved, which is otherwise only possible with binaural hearing device systems.

Modifications of multi-component hearing device systems that are not illustrated are also possible, in particular with regard to the allocation of the individual components of the inventive multi-stage activation circuit. It is also possible to have at least the components for level monitoring and signal analysis both in a component 11 in proximity to the ear and in an external additional device 12. This means that the component 11 of the hearing device worn in proximity to the ear initially remains autonomously functional, it being possible for individual activation functions expediently to be taken over by the additional device 12, when this is in proximity to the hearing device wearer.

If the hearing device is designed with multiple components it is advantageous, regardless of the inclusion of the transmit and receive unit 10 in the fourth stage 7 of the activation circuit in any instance, if each component 11 comprises at least means, for example in the form of a transmit and receive unit 10, which can transmit an activation signal and/or receive an activation signal in the event of activation and in the case of a received activation signal can bring about activation of the hearing device, thus ensuring coupled activation of the components 11.

Activation of at least individual hearing device components can therefore be initiated by way of the receipt of such an activation signal, without a noise having to be identified or classified, since an activation signal is received, which indicates the activation of a further hearing device or a further hearing device component.

The invention claimed is:

1. A hearing device with a multi-stage activation circuit, a signal processing and amplification circuit a microphone and an output unit, comprising:

a primary activation unit in a first stage of the activation circuit, an evaluation unit in a second stage of the activation circuit and to be activated by the primary activation unit; and a main activation unit in a third stage of the activation circuit, wherein the primary activation unit constantly monitors sound-induced input signals, activates the evaluation unit when a threshold level of the monitored input signals is exceeded, and forwards the sound-induced input signals to the activated evaluation unit, wherein the evaluation unit determines a feature of the forwarded input signals suitable for identifying and/or classifying a noise causing the respective signals, the evaluation unit having a storage unit having stored features associated to noises, wherein the main activation unit is activated by the evaluation unit when the feature determined by the evaluation unit indicates a noise that should be perceptible to the wearer of the hearing device, wherein the activated main activation unit activates further components such that a full activation of the hearing device occurs; and wherein the evaluation unit, the main activation unit, and the further components are automatically powered down when the preliminary activation unit determines that a minimum level of the input signals is not exceeded over a given time period.

2. The hearing device as claimed in claim 1, wherein the primary activation unit includes a signal buffer in which the input signals are recorded.

3. The hearing device as claimed in claim 2, wherein the signal buffer has a capacity to at least store the input signals received in a time duration between the exceeding of the threshold value and the activation of the evaluation unit.

4. The hearing device as claimed in claim 1, wherein a predetermined feature is stored in the storage unit, the predetermined feature selected from the group consisting of a typical telephone ring, typical alarm clock noises, typical speech patterns, music patterns and typical human voices being represented.

5. The hearing device as claimed in claim 1, wherein a plurality of predetermined features are stored in the storage unit, wherein at least one of the predetermined features selected from the group consisting of a typical telephone ring, typical alarm clock noises, typical speech patterns, music patterns and typical human voices being represented.

6. The hearing device as claimed in claim 1, wherein individually recorded features are stored in the storage unit.

7. The hearing device as claimed in claim 1, wherein a degree of correspondence between features stored in the storage unit and the feature of the respectively incoming signal is determined by the evaluation unit.

8. The hearing device as claimed in claim 1, wherein feature, which is suitable for identifying and/or classifying the noise causing the incoming signals, is a time-based frequency pattern of an incoming signal.

9. The hearing device as claimed in claim 1, wherein a fourth stage of the activation circuit is included, by way of which a manual activation/deactivation of the evaluation unit or a request for the content of the signal buffer can be effected.

10. The hearing device as claimed in claim 1, wherein the hearing device is a component of a binaurally coupled hearing device system and includes a transmitter to transmit an activation signal or a receiver to receive an activation signal such that the activation of the hearing device occurs in the event of a received activation signal.

11. The hearing device as claimed in claim 1, wherein the hearing device is designed as multiple components including an external device for activating the hearing device.

12. A method for activating a hearing device with a multi-stage activation circuit, the hearing device comprising: a microphone, a signal processing and amplification circuit, and an output unit, the method comprising:

monitoring a sound-induced input level by a primary activation unit in a first stage of the activation circuit;

activating an evaluation unit in a second stage of the activation circuit, the evaluation unit activated when a threshold value of the monitored input level is exceeded;

forwarding signals incoming to the primary activation unit to the evaluation unit;

determining by the evaluation unit a feature of the forwarded incoming signals, a degree of correspondence is determined between features stored in a storage unit and the feature of the respective incoming signal, the feature suitable for identifying and/or classifying a noise causing the incoming signals;

activating a main activation unit included in a third stage of the activation circuit when the identification and/or classification indicates a noise that should be perceptible to the wearer of the hearing aid; and activating by the main activation unit further components of the hearing device including the signal processing and amplification circuit and output unit.

13. The method as claimed in claim 12, wherein activation occurs independently of the evaluation unit after exceeding the threshold value for a time duration.

14. The method as claimed in claim 12, wherein an activation signal is transmitted to the hearing device by an external additional device, and an activation of at least some components of the hearing device occurs independently of the evaluation unit when the activation signal is received.

15. The method as claimed in claim 12, wherein a time-based frequency pattern of the incoming signal is determined as a feature suitable for identifying and/or classifying a noise causing the incoming signals.

16. A hearing device, comprising:

a microphone connected to a primary activation unit that is connected in turn to an evaluation unit that is connected in turn to a main activation unit that is connected in turn to an amplifier that is connected in turn to an audio output device for an ear of a user;

wherein the primary activation unit constantly monitors ambient sounds via input from the microphone;

wherein the primary activation unit determines when an ambient sound exceeds an input level threshold, and in that case, activates the evaluation unit and forwards an electronic representation of the ambient sound thereto;

wherein, upon activation, the evaluation unit determines a type of the ambient sound by comparing the ambient sound to a plurality of stored sound type recognition patterns, and, if the ambient sound matches one of the patterns, the evaluation unit activates the main activation unit and the amplifier, which then outputs the ambient sound to the audio output device; and wherein the evaluation unit, the main activation unit, the amplifier, and the audio output device are automatically switched to a power-saving rest mode when the preliminary activation unit determines that a minimum level of the input signals is not exceeded for a given duration.

17. The hearing device as claimed in claim 16, wherein the sound type recognition patterns are stored in a storage unit of the evaluation unit as time-frequency patterns representing sounds selected from the set of a telephone ring, an alarm clock noise, a speech pattern, and music.

* * * * *